US005081978A

United States Patent [19]

Sumida et al.

[11] Patent Number: 5,081,978

[45] Date of Patent: Jan. 21, 1992

[54] AUXILIARY AIR CONTROL VALVE FOR ENGINES

[75] Inventors: Mamoru Sumida; Osamu Matsumoto, both of Himeji, Japan

[73] Assignee: Mitsubishi Denki Kabushiki Kaisha, Tokyo, Japan

[21] Appl. No.: 627,805

[22] Filed: Dec. 14, 1990

[30] Foreign Application Priority Data

Dec. 18, 1989 [JP] Japan ..... 1-329327

[51] Int. Cl.[5] ..... F02D 9/00; F02D 41/00

[52] U.S. Cl. ..... 123/588; 123/585; 251/121

[58] Field of Search ..... 123/588, 585; 251/121

[56] References Cited

U.S. PATENT DOCUMENTS 4,480,614 11/1984 Kobashi et al. ..... 123/588
4,549,512 10/1985 Takao et al. ..... 123/588
4,870,944 10/1989 Matsumoto et al. ..... 123/585
4,879,982 11/1989 Itakura et al. ..... 123/588

FOREIGN PATENT DOCUMENTS 148246 9/1983 Japan ..... 123/588
183043 11/1987 Japan .

*Primary Examiner*—Andrew M. Dolinar
*Assistant Examiner*—M. Macy
*Attorney, Agent, or Firm*—Sughrue, Mion, Zinn, Macpeak and Seas

[57] ABSTRACT

An auxiliary air control valve for engines wherein the valve has an intermediate peripheral portion enlarged to present a small gap to the valve seat port, and the front side of the intermediate peripheral portion and the rear side thereof formed to have slant surfaces so as to be diametrically and gradually reduced so that when the cooling water is at a low temperature, the front slant surface is positioned at the valve seat port, when the cooling water is at an intermediate temperature, the intermediate peripheral portion is positioned at the valve seat port, and when the cooling water is at a high temperature, the rear slant surface is positioned at the valve seat port, thereby being capable of controlling the quantity of intake air through the bypass passage.

10 Claims, 2 Drawing Sheets

AUXILIARY AIR CONTROL VALVE FOR ENGINES

BACKGROUND OF THE INVENTION

1. Field of the Invention

The present invention relates to an auxiliary air control valve for engines, which can bypass a throttle valve in the intake passage of an internal combustion engine to control the supplied quantity of intake air.

2. Discussion of Background

There has been known a system wherein an internal combustion engine has a throttle valve arranged in an intake passage, and has fuel supplied in the form of injection by a fuel injection valve arranged in an intake manifold.

In that system, in order to prevent idling from being unstable at low temperatures, the arrangement of an auxiliary air control valve in a passage bypassing the throttle valve allows intake air to pass through the passage at low temperatures, thereby slightly increasing idling engine speed. On the other hand, when the engine is at high temperatures, bubbles can generate in the fuel within a delivery pipe of a fuel injector to deteriorate restart of the engine. It has been known that the auxiliary air control valve has a device which can pass bypassed intake air even at high temperatures, and that idling engine speed at high temperatures is slightly increased for easy restart of the engine.

As such a prior art reference, there is e.g. Japanese Unexamined Utility Model Publication No. 183043/1987. The conventional auxiliary air control valve disclosed in that publication is shown in section in FIG. 5. In FIG. 5, reference numeral 1 designates an auxiliary air control valve (hereinbelow, referred to as "the air control valve"). Reference numeral 2 designates a valve casing which has a one end portion formed with an inlet 3 for introducing a part of the cooling water for the engine and an outlet 4 for returning the introduced part of the cooling water to a cooling water pump of the engine. The valve casing 2 also has the other end portion formed with an air inlet port 5 and an air outlet port 6. The air inlet port 5 is connected to an introducing bypass passage which communicates with a location of an intake passage to the engine upstream of a throttle valve (not shown) arranged in the intake passage. The air outlet port 6 is connected to a return bypass passage which communicates with a location of the intake passage downstream of the throttle valve.

Reference numeral 7 designates a temperature dependent type actuator which is fixed in the valve casing 2, and which hermetically contains thermowax which expands and contracts depending on the ..mperature of the cooling water from the engine. The actuator 7 is provided with a cylindrical portion 8. Reference numeral 9 designates an operating rod which is supported in the cylindrical portion 8 so as to be axially movable, and which is protruded depending on the expansion of the thermowax. Reference numeral 10 designates an annular partition which is fixed in the valve casing 2, which separates an air inlet side and an air outlet side in the valve casing 2, and which has a valve seat port 10*a* formed therein. Reference numeral 11 designates a valve rod which has its rear end portion provided with a sleeve to be slidably supported by the cylindrical portion 8, and which projects depending on the protrusion of the operating rod 9. The leading edge of the valve rod 11 extends to the position where the partition

10 is located, and has a retaining ring 12 fitted in its end. The valve rod 11 has a groove 13 formed therein to axially extend. Reference numeral 14 designates a valve which is slidably carried on the valve rod 11, which has its periphery faced to the valve seat port 10*a* with a small gap, and which has its leading portion tapered.

The sleeve of the valve rod 11 has a spring seat 15 mounted thereto, and a spring 16 is arranged between the spring seat 15 and the partition 10 to urge the valve rod 11 in a retracted or backward direction. The valve 14 is urged against the retaining ring 12 by a spring 17 which is arranged between the valve 14 and the spring seat 15.

In FIG. 5, there is shown the operating state wherein the cooling water is at an intermediate temperature. The heat expansion of the thermowax moves the operating rod 9 forth (in the rightward direction in FIG. 5), followed by forward movement of the valve rod

11 As a result, the periphery of the valve 14 confronts the valve seat port 10*a* to restrict the quantity of air introduced into the bypass passage to an amount which is near to zero.

When the cooling water is at low temperatures, the heat contraction of the thermowax makes the operating rod 9 retractable. The valve rod 9 is retracted by the spring force of the spring 16. As a result, the valve 14 which is carried on the valve rod 9 is retracted, and the tapered edge confronts the valve seat port 10*a*, thereby allowing the inspired air to fully pass through the bypass passage.

On the other hand, when the cooling water is at high temperatures, the extent of the heat expansion of the thermowax is greater than the case of FIG. 5, and the operating rod 9 is moved further forth than the case of FIG. 5. As a result, the valve rod 11 is moved further forth against the action of the spring 16 though the valve 14 is stopped by the partition 10 on the way to be prevented from moving forth. Because the valve rod 11 can move further forth than the valve 14, the groove 13 communicates the air inlet side to the air outlet side to allow the introduced air to pass through the bypass passage.

In that manner, the quantity of the air introduced into the bypass passage is controlled depending on the cooling water temperature (corresponding to the temperature of the engine) as shown in FIG. 6. This arrangement facilitates starting even if the engine is at low temperatures or high temperatures.

The conventional air control valve stated earlier requires the provision of the groove 13 in the valve rod 11, the machining of the groove 13 being very complicated. The valve rod 11 has to be combined with the valve 14 which is a separate part. Two kinds of the springs 16 and 17 are also needed. It creates problems in that the number of required parts is great, the structure is complicated, the production cost is high, and the size is large.

SUMMARY OF THE INVENTION

It is an object of the present invention to solve these problems and to provide a new and improved auxiliary air control valve for engines capable of simplifying the structure, decreasing the number of required parts, lowering the production cost, and minimizing the size.

The foregoing and other objects of the present invention have been attained by providing an auxiliary air control valve for engines comprising a valve casing having an air inlet port and an air outlet port, the ports being connected to a bypass passage for a throttle valve in an intake passage to an engine; a temperature dependent type actuator which is housed in the valve casing, which cooling water to the engine is partly branched to be introduced to, and which is depending on the temperature of the cooling water; a valve seat which is arranged in the valve casing to divide its inside into an air inlet side and an air outlet side, and which has a valve seat port formed therein; an operating rod which is supported by the actuator so as to be axially movable, and which can be moved forwardly under temperature dependent operation of the actuator; a valve which is supported and can be moved forwardly by the operating rod, and which can have a forward end peripheral portion confronted the valve port; and means which is arranged between a rear end of the valve and the valve seat to urge the valve backwardly; wherein the valve has an intermediate peripheral portion enlarged to present a small gap to the valve seat port, and the front side of the intermediate peripheral portion and the rear side thereof formed to have slant surfaces so as to be diametrically and gradually reduced so that when the cooling water is at a low temperature, the front slant surface is positioned at the valve seat port, when the cooling water is at an intermediate temperature, the intermediate peripheral portion is positioned at the valve seat port, and when the cooling water is at a high temperature, the rear slant surface is positioned at the valve seat port, thereby being capable of controlling the quantity of intake air through the bypass passage.

In accordance with the present invention, when the engine is at a low temperature, the actuator generates a small output to allow the spin to move the valve backwardly. As a result, the front slant surface confronts the valve seat port, allowing the intake air to pass through the bypass passage. When the engine is at an intermediate temperature, the actuator acts to move the valve forwardly through the operating rod. As a result, the intermediate peripheral portion reaches the valve seat port to restrain the passage of the intake air in the bypass passage at the minimum level. When the engine is at a high temperature, the actuator generates a great output to move the valve further forwardly through the operating rod. As a result, the rear slant surface arrives at the valve seat port to allow the intake air to pass through the bypass passage at a given amount. In this way, even when the engine is at a low temperature and at a high temperature, the flowing rate of the intake air in the bypass passage can be suitably controlled to feed the air to the engine, facilitating starting. In addition, the structure of the air control valve is simplified, the number of parts is reduced, the production cost is lowered, and the size of the control valve is minimized.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DESCRIPTION OF THE PREFERRED EMBODIMENTS

Figure 1:
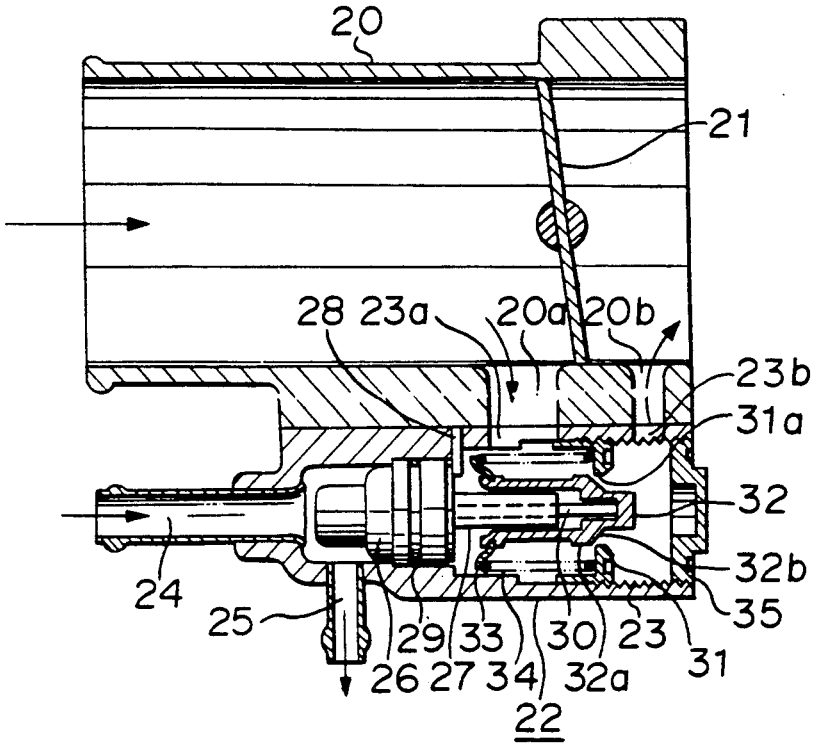
FIG. 1 is a cross sectional view of a first embodiment of the auxiliary air control valve for engines according to the present invention.

Referring now to the drawings, wherein like reference numerals designates identical or corresponding parts throughout the several views, and more particularly to FIG. 1 thereof, there is shown a cross sectional view of a first embodiment of the auxiliary air control valve for engines according to the present invention, wherein the control valve is mounted to a throttle valve housing. In FIG. 1, reference numeral 20 designates the throttle valve housing (hereinbelow, referred to as the housing) which has a throttle valve 21 arranged therein and constitutes a part of the intake passage to an engine. The housing 20 has its wall formed with a branch outlet port 20*a* and a branch inlet port 20*b* for bypassing the throttle valve 21.

Reference numeral 22 designates an auxiliary air control valve which is mounted to the housing 20, and which is constituted as follows: reference numeral 23 designates a valve casing which has an air inlet port 23*a* and an air outlet port 23*b* formed therein at one end portion. The valve casing 23 has the other end portion a cooling water inlet 24 and a cooling water outlet 25 so that the cooling water which has left the engine through a bypass passage goes into and out of the valve casing 23 through the inlet 24 and the outlet 25. Reference numeral 26 designates a temperature dependent type actuator which is fixed in the valve casing 23, which has e.g. thermowax sealed therein, and from which a cylindrical portion 27 project toward the one end portion. Reference numeral 28 designates a retaining pin which is driven into the valve casing 23 to prevent the actuator 26 from slipping out of the valve casing 23. Reference numeral 29 designates an O ring. Reference numeral 30 designates an operating rod which is supported by the cylindrical portion 27 of the actuator 26 so as to be axially movable, and which is moved forth under the thermal expansion of the thermowax. Reference numeral 31 designates an annular valve seat which is fixed in the valve casing 23, which divides the inside of the valve casing 23 into an air inlet side and an air outlet side, and which has a valve seat port 31*a* formed therein. Reference numeral 32 designates a valve which is slidably fit on the leading portion of the operating rod 30 to be supported by the operating rod 30. The valve 32 is made of a substantially cylindrical member with its leading end closed. The cylindrical member has its rear end provided with a spring seat 33. A spring 34 is arranged between the spring seat 33 and the valve seat 31 to urge the valve 32 backwardly.

Figure 2:
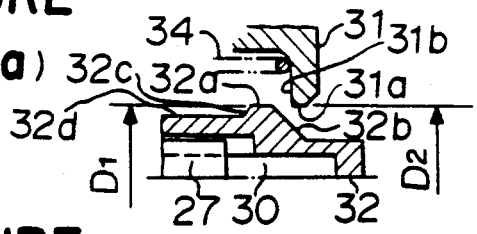
FIGS. 2A through 2C are cross sectional views of the essential parts showing the position of the valve to the valve seat port of FIG. 1.
Figure 2:
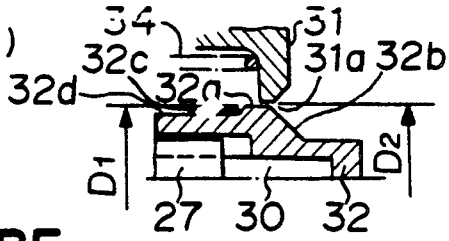
Figure 2:
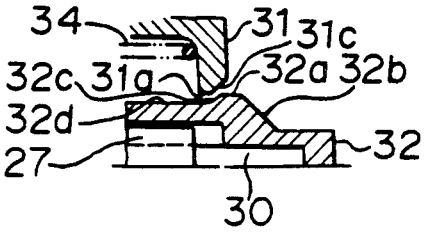

In more detail, the peripheral portion of the valve 32 is formed as shown in FIG. 2A. Specifically, the outer diameter D1 of an intermediate peripheral portion 32*a* of the valve 32 is determined so that when the intermediate peripheral portion 32*a* confronts the inner wall of the valve seat port 32*a*, a given small gap is formed between the intermediate peripheral portion 32*a* and the valve seat port 31*a* having an internal diameter D2. When the intermediate peripheral portion 32*a* is located at the position of the valve seat port 31*a* as shown in FIG. 2B, the leakage amount of the intake air which passes through a bypass passage is kept at a certain small level. The front side of the intermediate peripheral portion 32*a* of the valve 32 is formed to have its outer diameter. The rear side of the intermediate peripheral portion 32*a* is formed to have a tapered slant surface 32*c*, thereby gradually decreasing its outer diameter so that the minimum diameter of the rear side is greater than that of the front side. A rear end peripheral portion 32*d* extends backwardly from the rear side of the intermediate peripheral portion 32*a*, having the same outer diameter as that of the most reduced portion of the rear side 32*c* of the intermediate peripheral portion 32*a*. Referring back to FIG. 1, reference numeral 35 designates a sealing cap which is screwed in the front end of the valve casing 23.

In the air control valve 22 according to the first embodiment, when the engine is at a low temperature and the cooling water is also at a low temperature, the actuator 26 generates a small output, thereby causing the valve 32 to be backwardly moved by the spring 34, which is shown in FIG. 2A. At that time, the valve 32 has the front side slant surface 32*b* confronted a rear corner 31*b* of the valve seat port 31*a* to allow the bypassed intake air to flow through the gap which is formed between the slant surface 32*b* and the corner 31*b*. In this way, the amount of the intake air is controlled depending on a backward location of the valve 32.

When the engine is at an intermediate temperature and the cooling water is also at an intermediate temperature (e.g. 50–80° C.), the actuator 26 moves the valve 32 forth through the operating rod 30. As a result, as shown in FIG. 2B, the intermediate peripheral portion 32*b* reaches the position of the valve seat port 32*a* to make the valve nearly closed. In that time, the bypassed intake air is passing through a little gap, and is flowing at a certain small leakage amount.

Now, when the engine is at a high temperature and the cooling water is also at a high temperature, e.g. 80° C. or above, the actuator 26 moves the valve 32 further forth through the operating rod 30. As shown in FIG. 2C, the rear side slant surface 32*c* reaches the position of a front corner 31*c* of the valve seat port 31*a* to allow the bypassed intake air to pass through the gap which is formed between the rear side slant surface 32*c* and the front corner 31*c*.

As explained, the actuator 26 moves the valve 32 forwardly and backwardly depending c the temperature of the engine to control the amount of the intake air at a level which is required on starting. This arrangement facilitates starting.

Figure 3:
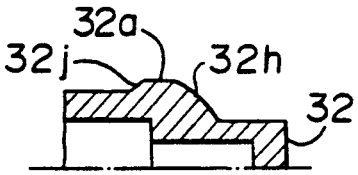
FIG. 3 is a cross sectional view of the essential portion of the valve according to a second embodiment.
Figure 4:
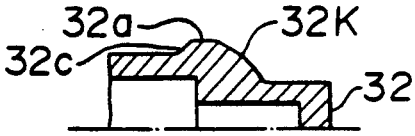
FIG. 4 is a cross sectional view of the essential portion of the valve according to a third embodiment.
Figure 5:
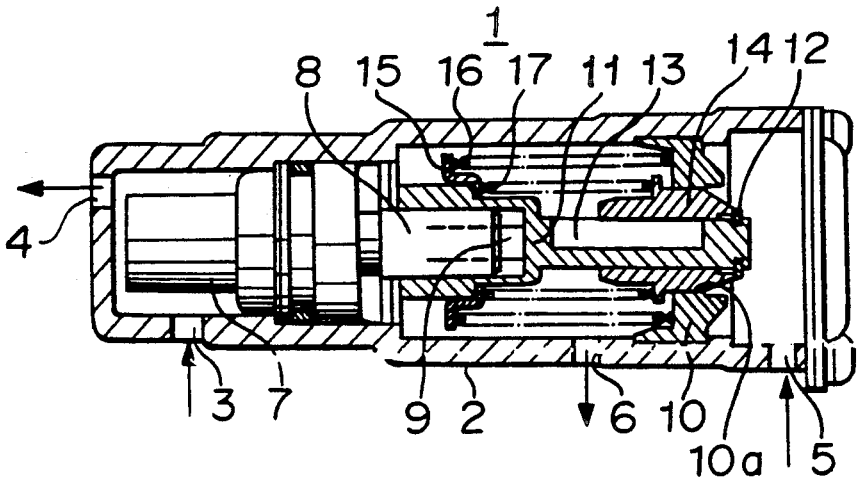
FIGURE 5 PRIOR ART
FIG. 5 is a cross sectional view of a conventional auxiliary air control valve for engines.
Figure 6:
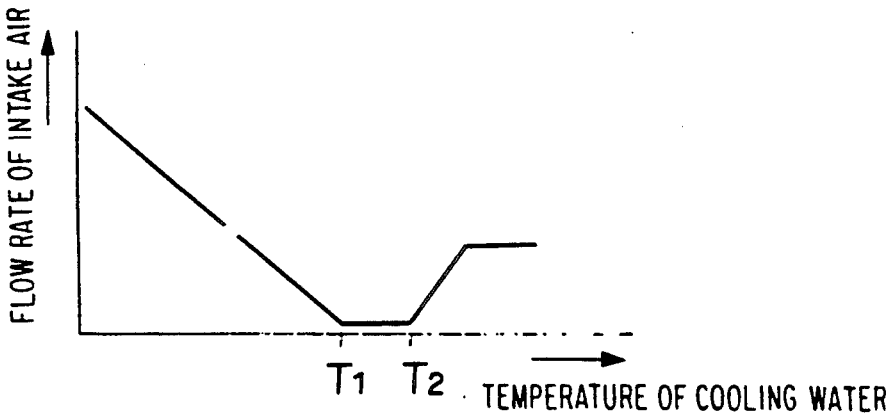
FIG. 6 is a graph of curve showing the relation of bypassed air intake quantity to cooling water temperature which is under control of the conventional control valve.

Referring now to FIGS. 3 and 4, there are shown cross sectional views of the essential portion of the valve according to a second and a third embodiment of the present invention. In the second embodiment of FIG. 3, the intermediate peripheral portion 32*a* of the valve 32 have the front side slant surface and the rear side slant surface formed to present round surfaces 32*h* and 32*j*, respectively.

In the third embodiment of FIG. 4, the intermediate peripheral portion 32*a* of the valve 32 has the front side slant surface formed to present a two stepped tapered surface 32*k*.

Although the valve casing 23 has the air inlet 23*a* formed at an intermediate portion and the air outlet 23*b* formed at a front side in the embodiments, the locations interchanged.

Although the air control valve 22 is mounted directly to the throttle valve housing 20, it is possible to adopt such an arrangement that the air control valve 22 is mounted to another part, a bypass tube is extended from the throttle valve housing 20 to bypass the throttle valve 21, and the valve casing 23 has the air inlet and the air outlet connected to the extended bypass tube.

Although the explanation of the embodiments as stated earlier has been made for the case wherein the temperature dependent type actuator has the thermowax sealed therein, an actuator which uses another thermal expanding material such as a bimetallic member or a shape memory alloy is applicable to the present invention.

Obviously, numerous modifications and variations of the present invention are possible in light of the above teachings. It is therefore to be understood that within the scope of the appended claims, the invention may be practiced otherwise than as specifically described herein.

What is claimed is:

1. An auxiliary air control valve for engines comprising:

a valve casing having an air inlet port and an air outlet port, the ports being connected to a bypass passage for a throttle valve in an intake passage to an engine;

a temperature dependent type actuator which is housed in the valve casing, which cooling water to the engine is partly branched to be introduced to, and which is depending on the temperature of the cooling water;

a valve seat which is arranged in the valve casing to divide its inside into an air inlet side and an air outlet side, and which has a valve seat port formed therein;

an operating rod which is supported by the actuator so as to be axially movable, and which can be moved forwardly under temperature dependent operation of the actuator;

a valve which is supported and can be moved forwardly by the operating rod, and which can have a forward end peripheral portion confronted with the valve port; and means which is arranged between a rear end of the valve and the valve seat to urge the valve backwardly;

wherein the valve has an intermediate peripheral portion enlarged to present a small gap to the valve seat port, and the front side of the intermediate peripheral portion and the rear side thereof formed to have slant surfaces so as to be diametrically and gradually reduced so that when the cooling water is at a low temperature, the front slant surface is positioned at the valve seat port, when the cooling water is at an intermediate temperature, the intermediate peripheral portion is positioned at the valve seat port, and when the cooling water is at a high temperature, the rear slant surface is positioned at the valve seat port, thereby being capable of controlling the quantity of intake air through the bypass passage.

2. An auxiliary air control valve according to claim 1, wherein the outer diameter of the intermediate peripheral portion is determined so that when the intermediate peripheral portion reaches the position of the valve seat port, a given small gap is defined between the intermediate peripheral portion and the valve seat port.

3. An auxiliary air control valve according to claim 1, wherein the front side of the intermediate peripheral portion is formed to have a tapered slant surface, thereby gradually decreasing its outer diameter.

4. An auxiliary air control valve according to claim 2, wherein the rear side of the intermediate peripheral portion is formed to have a tapered slant surface, thereby gradually decreasing its outer diameter, the minimum diameter of the rear side being larger than that of the front side.

5. An auxiliary air control valve according to claim 4, wherein the intermediate peripheral portion has a rear portion extended from the rear side of the intermediate peripheral portion, the rear portion having the same outer diameter as the minimum diameter of the rear side of the intermediate peripheral portion.

6. An auxiliary air control valve according to claim 1, wherein the front side of the intermediate peripheral portion has the slant surface formed to have a round surface.

7. An auxiliary air control valve according to claim 1, wherein the rear side of the intermediate peripheral portion has the slant surface formed to have a round surface.

8. An auxiliary air control valve according to claim 1, wherein the front side of the intermediate peripheral portion has the slant surface formed to have a plurality of tapered surfaces.

9. An auxiliary air control valve according to claim 1, wherein the valve seat port has a front corner cut out.

10. An auxiliary air control valve according to claim 1, wherein the means for urging the valve backwardly is a spring.

* * * * *